US008556305B2

(12) United States Patent
Juan et al.

(10) Patent No.: US 8,556,305 B2
(45) Date of Patent: Oct. 15, 2013

(54) AUTOMATIC LOCKING/UNLOCKING APPARATUS FOR A DRAWER

(75) Inventors: Teng-Yi Juan, Taipei (TW); Shih-Wang Chen, Taipei (TW)

(73) Assignee: Sun Chain Metal Industry Co., Ltd., Taipei (TW)

( * ) Notice: Subject to any disclaimer, the term of this patent is extended or adjusted under 35 U.S.C. 154(b) by 329 days.

(21) Appl. No.: 13/025,844

(22) Filed: Feb. 11, 2011

(65) Prior Publication Data

US 2012/0001441 A1 Jan. 5, 2012

(30) Foreign Application Priority Data

Jul. 2, 2010 (TW) ..... 99212600 U

(51) Int. Cl.
*E05C 1/12* (2006.01)
*E05C 1/00* (2006.01)

(52) U.S. Cl.
USPC ..... 292/164; 292/1; 292/332; 292/DIG. 4; 312/333

(58) Field of Classification Search
USPC ..... 292/1, 164, 332–336, DIG. 4; 312/333, 312/319.1, 334.44, 334.46, 334.47
See application file for complete search history.

(56) References Cited

U.S. PATENT DOCUMENTS 1,509,780 A * 9/1924 Robertson ..... 292/198
3,674,329 A * 7/1972 Schill ..... 312/319.1
4,482,175 A * 11/1984 Sugie ..... 292/45
4,657,292 A * 4/1987 Bruck ..... 292/80
5,090,751 A * 2/1992 Kobayashi ..... 292/71
5,845,954 A * 12/1998 DePue ..... 296/37.12
7,201,411 B2 * 4/2007 Bella et al. ..... 292/336.3
7,303,216 B2 * 12/2007 Bella et al. ..... 292/303
7,374,261 B1 * 5/2008 Wang ..... 312/333
7,393,026 B2 * 7/2008 Ikeda et al. ..... 292/341.15
7,533,946 B2 * 5/2009 Hoffman ..... 312/333
7,600,828 B2 * 10/2009 Chen et al. ..... 312/333
7,802,856 B2 * 9/2010 Hashemi et al. ..... 312/334.46
7,878,606 B2 * 2/2011 Chen et al. ..... 312/333
8,052,181 B2 * 11/2011 Nishida ..... 292/332
8,256,853 B2 * 9/2012 Chen et al. ..... 312/333
8,393,693 B2 * 3/2013 Juan et al. ..... 312/333
8,398,130 B2 * 3/2013 Park et al. ..... 292/333
2008/0136300 A1 * 6/2008 Wang ..... 312/319.1
2009/0160299 A1 * 6/2009 Chen et al. ..... 312/334.44
2010/0164340 A1 * 7/2010 Juan et al. ..... 312/333
2011/0210653 A1 * 9/2011 Salice ..... 312/319.1
2011/0215690 A1 * 9/2011 Juan et al. ..... 312/319.1
2012/0062088 A1 * 3/2012 Chen et al. ..... 312/319.1

FOREIGN PATENT DOCUMENTS

DE 4011722 A1 * 10/1990 ..... E05C 19/16
JP 04001379 A * 1/1992 ..... E05C 17/30

* cited by examiner

*Primary Examiner* — Carlos Lugo
(74) *Attorney, Agent, or Firm* — Banger Shia

(57) ABSTRACT

A locking/unlocking apparatus for a drawer is applicable to be assembled on a fixed slide rail and a slidable slide rail of a drawer or on a drawer body and a drawer cabinet. The locking/unlocking apparatus comprises a drive element disposed on the slidable slide rail or the drawer body, a main body fixed on the fixed slide rail or the drawer cabinet, a slide block slidably disposed on the main body, and a spring disposed between the main body and the slide block. By such arrangements, when the drawer is pulled by a large force, it can prevent the slide rails, the drawer body or the locking/unlocking apparatus from being damaged.

5 Claims, 12 Drawing Sheets

AUTOMATIC LOCKING/UNLOCKING APPARATUS FOR A DRAWER

BACKGROUND OF THE INVENTION

1. Field of the Invention

The present invention relates to a drawer, and more particularly to a locking/unlocking apparatus for a drawer.

2. Description of the Prior Art

Referring to FIG. 1, a first conventional automatic unlocking apparatus for drawer slide rails is provided with a top fastener 83 and a fastening element 54 on an external slide rail 81 and an inner surface of a pull rod 82. The top fastener 83 includes a main body 832 and loading plate 831 centrally extending along one side the main body 832. The main body 832 is provided at each of two opposite sides thereof with a protruding cylinder 8321 on which an elastic element 85 is mounted. A fixing fastener 86 is mounted on the loading plate 831 and provided with a hook (not shown) on the inner surface thereof, and a guiding cylinder 861 at a distal end thereof. The hook is movably engaged in the main body 832. A sliding sleeve assembly 87 is provided at both ends thereof with two sleeves 871 connected to the elastic elements 85. The main body of the sliding sleeve assembly 87 is disposed under the loading plate 831 and allowed to side along the slide rails of the loading plate 831. The fastening element 84 is provided with a guiding portion (not shown) and a shaft seat (not shown). The slide rails can be locked and unlocked easily by pressing the pull rod 82.

Referring to FIG. 2, a second conventional automatic locking apparatus for drawer slide rails is also disposed between an external slide rail 92 and an internal slide rail 91. The automatic locking apparatus comprises a guiding block 93 cooperating with a spring 94, a moving element 95, a buffer element 96, a first protruding element 97 and a second protruding element 98, offering an automatic locking function.

However, no matter how the unlocking or locking apparatus for drawer slide rails are designed, they have a common defect that the user cannot tell if the drawer is in a locking or an unlocking state from the outside, so that once the user pulls the drawer which is in the locking state by a large force accidentally, the slide rails or the automatic locking apparatus will be damaged inevitably.

The present invention has arisen to mitigate and/or obviate the afore-described disadvantages.

SUMMARY OF THE INVENTION

The primary objective of the present invention is to provide a locking/unlocking apparatus for a drawer which can prevent the slide rails or itself from being damaged when the drawer in the locking state is pulled by a large force besides automatically performing the locking or unlocking operation by pressing.

The secondary objective of the present invention is to provide a locking/unlocking apparatus for a drawer which can prevent the drawer body or itself from being damaged when the drawer in the locking state is pulled by the large force besides automatically performing the locking or unlocking operation by pressing.

Hence, to achieve the above objective, a locking/unlocking apparatus for a drawer in accordance with the present invention is assembled on a fixed slide rail and a slidable slide rail of a drawer, and the locking/unlocking apparatus comprises:

a drive element being formed on the slidable slide rail and including a drive portion;

a main body being fixed on the fixed slide rail and including a rail groove, a bar hole formed in a bottom surface of the rail groove, a slot which is formed above the bar hole and will deform when being pressed, and an annular guide groove in communication with the rail groove, the annular guide groove including an internal annular surface and an external annular surface connected to a groove surface of the rail groove, the internal annular surface including a concave portion, the external annular surface including a protruding portion in alignment with the concave portion;

a slide block including a first protrusion to be pushed by the drive portion of the drive element, a second protrusion to be pushed by the drive portion of the drive element, a first protruding cylinder which is slidably disposed in the rail groove and engaged in/disengaged from the concave portion of the annular guide groove, and a second protruding cylinder which is slidably disposed in the rail groove; and a spring including a first end connected to the main body, and a second end connected to the slide block.

In addition, a locking/unlocking apparatus for a drawer in accordance with the present invention can also be applicable to be assembled on a drawer body and a drawer cabinet and comprises:

a drive element being disposed on the drawer body and including a drive portion;

a main body being fixed on the drawer cabinet and including a rail groove, a bar hole formed in a bottom surface of the rail groove, a slot which is formed above the bar hole and will deform when being pressed, and an annular guide groove in communication with the rail groove, the annular guide groove including an internal annular surface and an external annular surface connected to a groove surface of the rail groove, the internal annular surface including a concave portion, the external annular surface including a protruding portion in alignment with the concave portion;

a slide block including a first protrusion to be pushed by the drive portion of the drive element, a second protrusion to be pushed by the drive portion of the drive element, a first protruding cylinder which is slidably disposed in the rail groove and engaged in/disengaged from the concave portion of the annular guide groove, and a second protruding cylinder which is slidably disposed in the rail groove; and a spring including a first end connected to the main body, and a second end connected to the slide block.

Preferably, the rail groove of the main body includes a first groove section, a second groove section bent from a first end of the first groove section, and a third groove section bent from a second end of the first groove section, and the bar hole is formed in the first groove section.

Preferably, the internal annular surface is formed by annularly connecting an upper guide surface, a first surface, a second surface, and a lower guide surface in order, the first surface and the second surface that are connected form a concave portion, the protruding portion of the annular guide groove is higher than the second surface but lower than the first surface.

Preferably, the main body further includes an engaging portion connected to the first end of the spring, and the slide block further includes a fastening portion connected to the second end of the spring.

Preferably, when the first protruding cylinder of the slide block is engaged in the concave portion, the second protruding cylinder is located in the bar hole and the slot.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
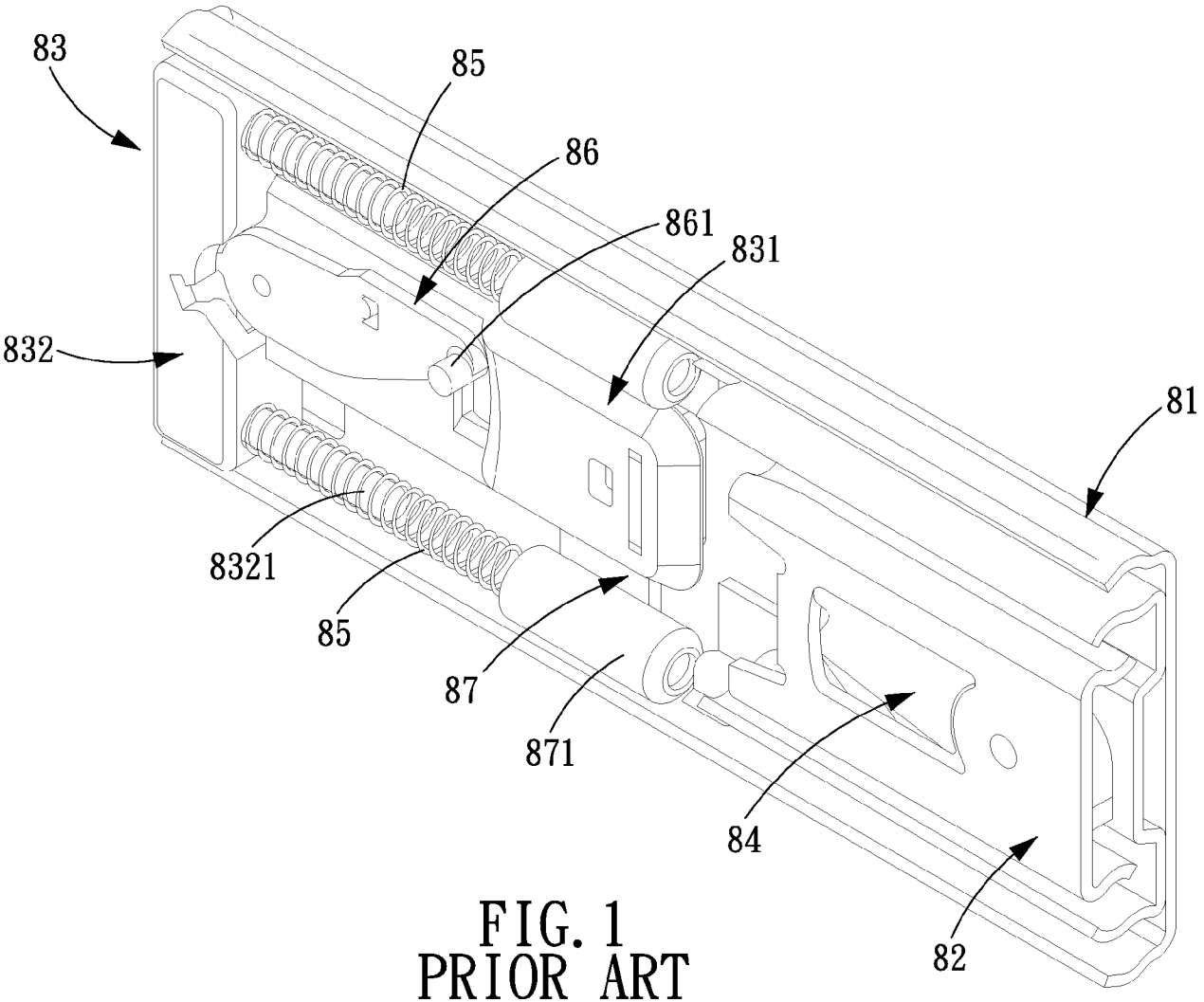
FIG. 1 PRIOR ART
FIG. 1 is a perspective view of a conventional automatic unlocking apparatus.
Figure 2:
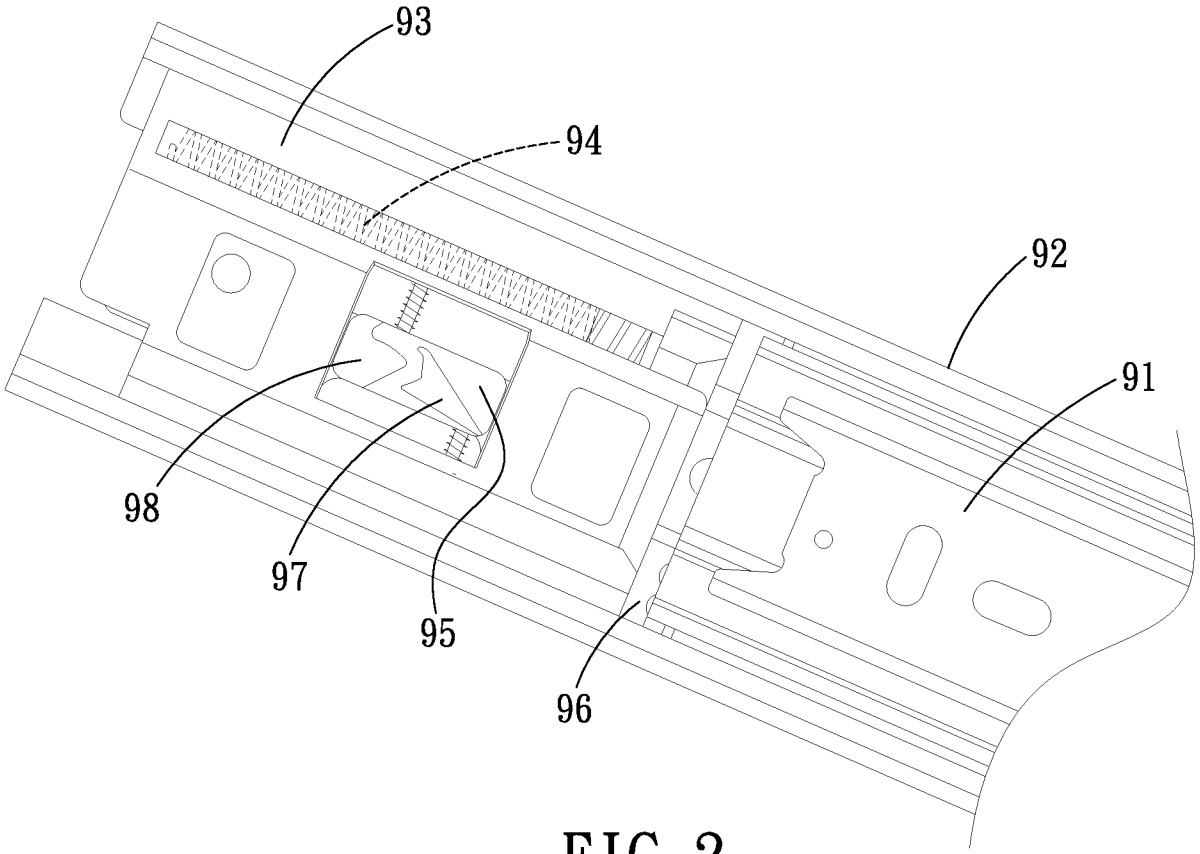
FIG. 2 PRIOR ART
FIG. 2 is a planar view of a conventional automatic locking apparatus.
Figure 3:
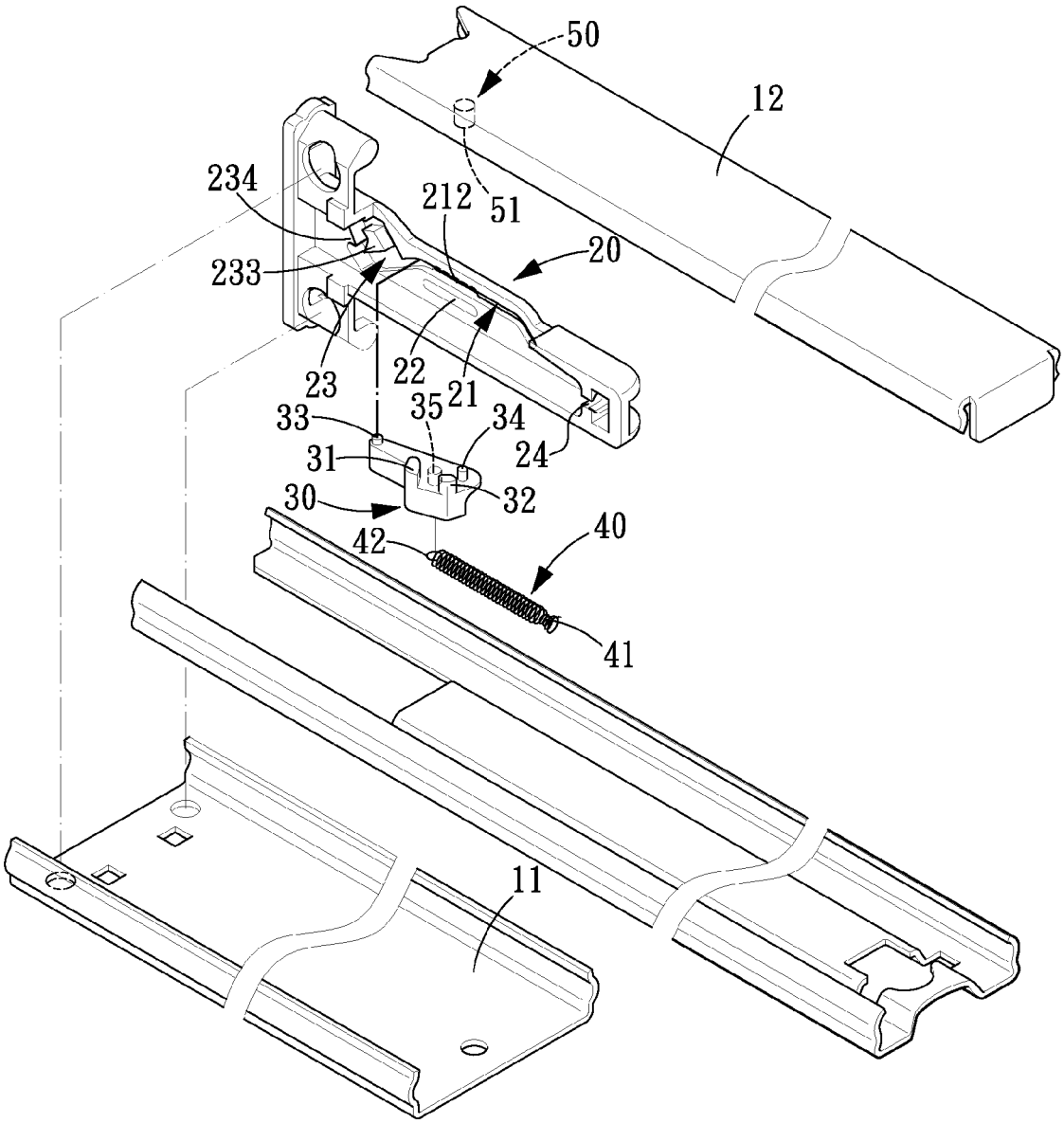
FIG. 3 is a perspective exploded view of a locking/unlocking apparatus for a drawer in accordance with a first embodiment of the present invention.
Figure 4:
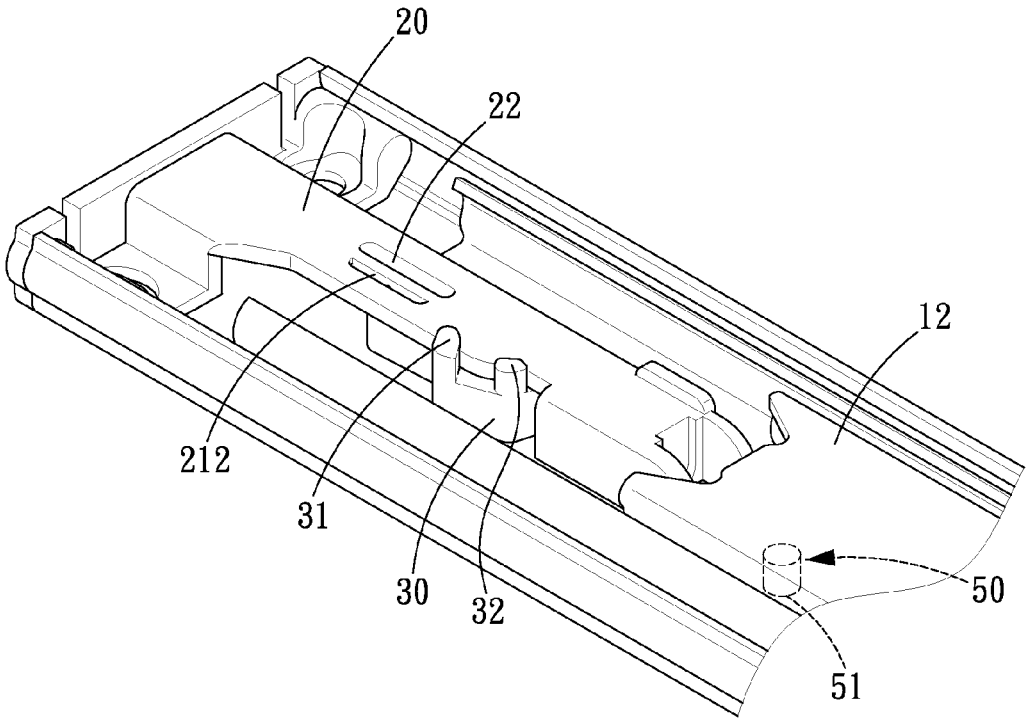
FIG. 4 is a perspective assembly view of the locking/unlocking apparatus for a drawer in accordance with the first embodiment of the present invention.
Figure 5:
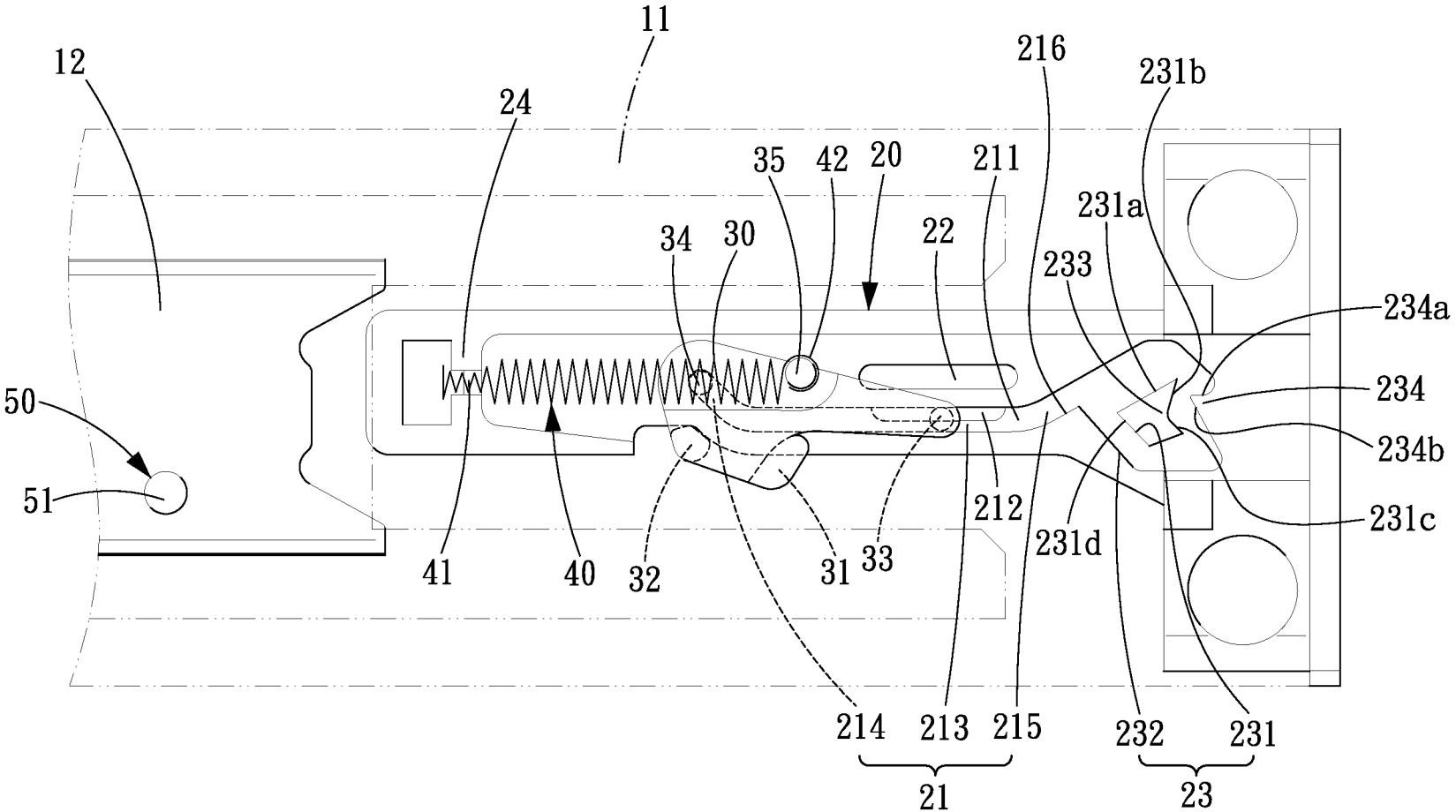
FIG. 5 is a side assembly view of the locking/unlocking apparatus for a drawer in accordance with the first embodiment of the present invention.

Referring to FIGS. 3-5, a locking/unlocking apparatus for a drawer in accordance with a first embodiment of the present invention is applicable to be assembled on a fixed slide rail 11 and a slidable slide rail 12 and comprises a drive element 50, a main body 20, a slide block 30 and a spring 40.

The drive element 50 is formed on the slidable slide rail 12 and includes a drive portion 51.

The main body 20 is fixed on the fixed slide rail 11 in the direction as shown in FIG. 3. The main body 20 includes a rail groove 21, a bar hole 212 formed in a bottom surface 211 of the rail groove 21, a slot 22 which is formed above the bar hole 212 and will deform when being pressed, an annular guide groove 23 in communication with the rail groove 21, and an engaging portion 24. Furthermore, the rail groove 21 includes a transverse first groove section 213, a second groove section 214 bent toward an upper-left direction from a first end of the first groove section 213, and a third groove section 215 bent toward an upper-right direction from a second end of the first groove section 213. The bar hole 212 is formed in the first groove section 213, and the third groove section 215 is connected to the annular guide groove 23. The annular guide groove 23 includes an internal annular surface 231 and an external annular surface 232 connected to a groove surface 216 of the rail groove 21. The internal annular surface 231 is formed by annularly connecting an upper guide surface 231*a*, a first surface 231*b*, a second surface 231*c*, and a lower guide surface 231*d* in order. The first surface 231*b* and the second surface 231*c* are connected to form a concave portion 233. The external annular surface 232 includes a protruding portion 234 in alignment with the concave portion 233. The protruding portion 234 of the annular guide groove 23 is higher than the second surface 231*c* but lower than the first surface 231*b*.

The slide block 30 includes a first protrusion 31 to be pushed by the drive portion 51 of the drive element 50, a second protrusion 32 to be pushed by the drive portion 51 of the drive element 50, a first protruding cylinder 33 which is slidably disposed in the rail groove 21 and engaged in/disengaged from the concave portion 233 of the annular guide groove 23, a second protruding cylinder 34 which is slidably disposed in the rail groove 21, and a fastening portion 35. Moreover, when the first protruding cylinder 33 of the slide block 30 is engaged in the concave portion 233 of the main body 20, the second protruding cylinder 34 is located in the bar hole 212 of the rail groove 21 and the slot 22.

The spring 40 includes a first end 41 connected to the engaging portion 24 of the main body 20, and a second end 42 connected to the fastening portion 35 of the slide block 30 for providing a force pulling the slide block 30 to move toward the second groove section 214 of the rail groove 21.

The aforementioned is the summary of the positional and structural relationship of the respective components of the preferred embodiment in accordance with the present invention.

Figure 6:
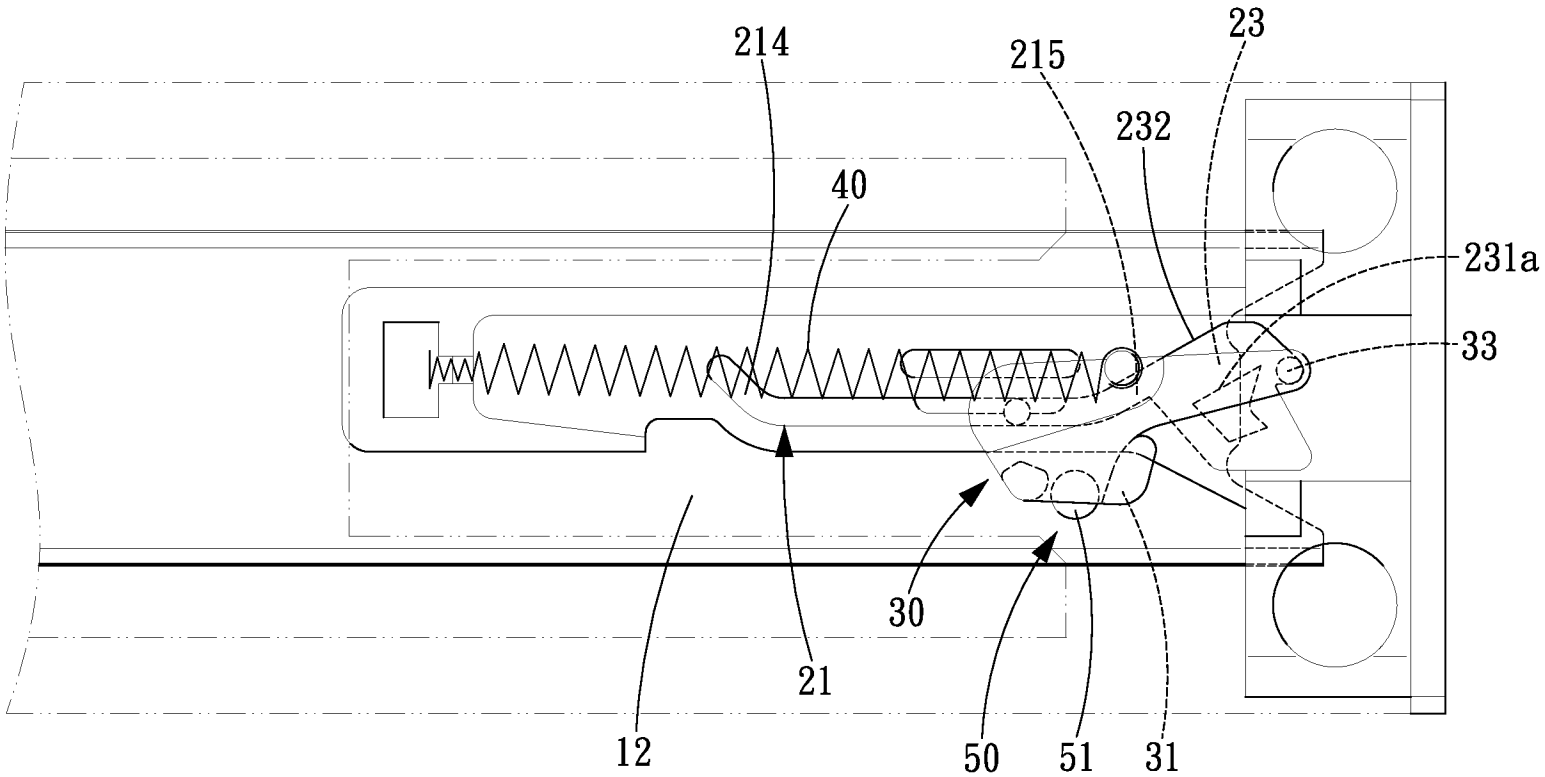
FIG. 6 is a first operational view, showing the locking/unlocking apparatus for a drawer in accordance with the first embodiment of the present invention performs the locking operation.
Figure 7:
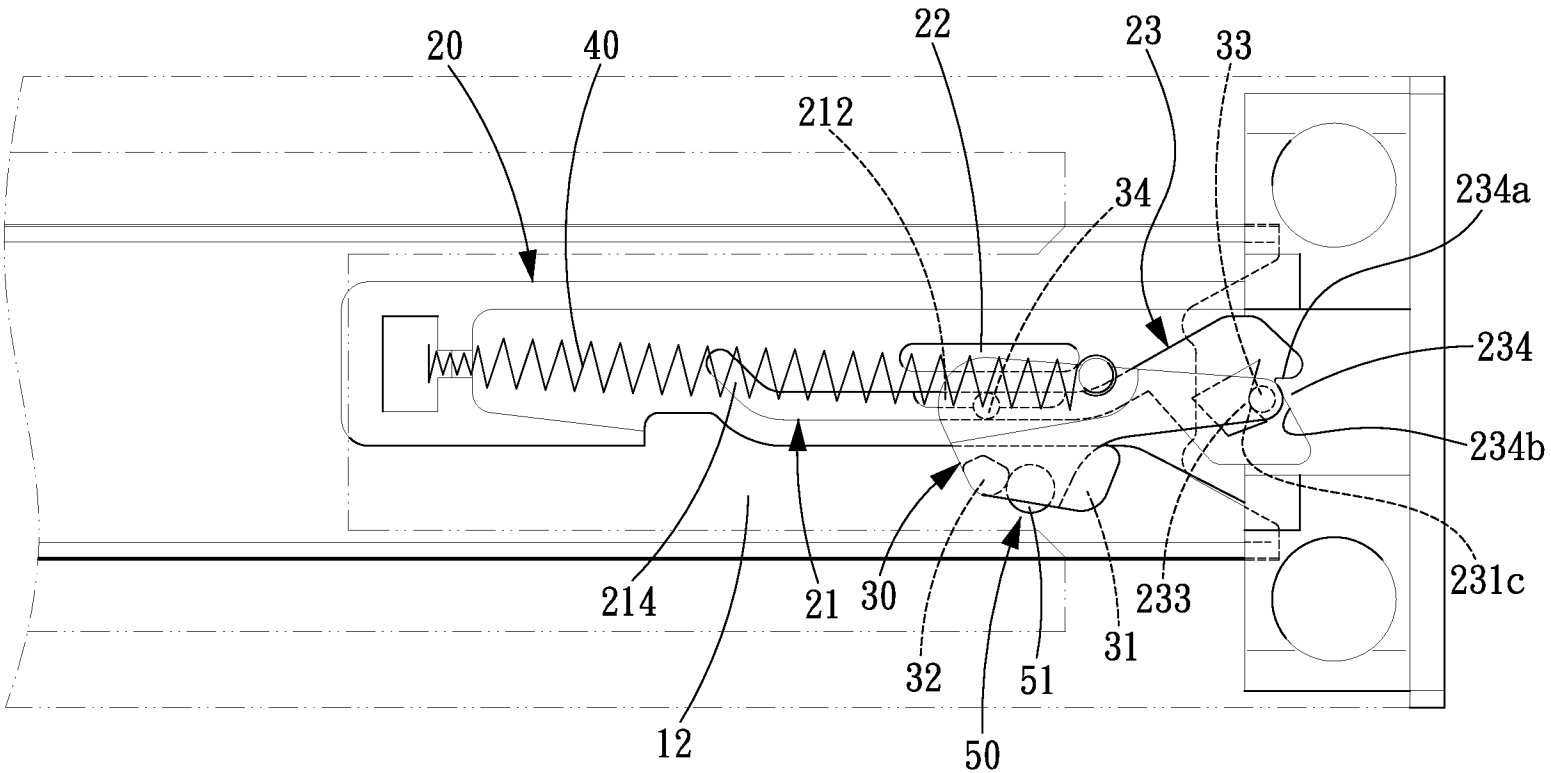
FIG. 7 is a second operational view, showing that the locking/unlocking apparatus for a drawer in accordance with the first embodiment of the present invention performs the locking operation.
Figure 8:
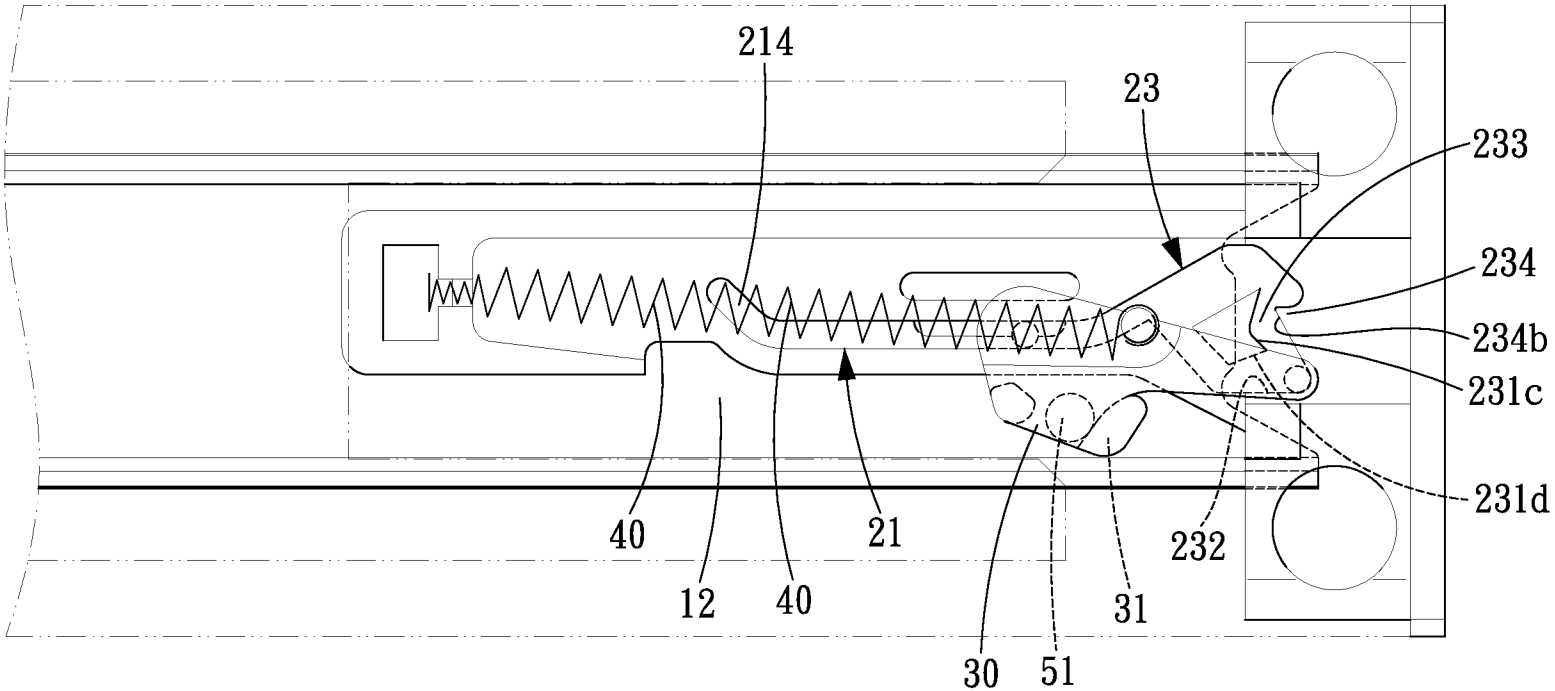
FIG. 8 is a third operational view, showing that the locking/unlocking apparatus for a drawer in accordance with the first embodiment of the present invention performs the unlocking operation.

For a better understanding of the present invention, its operation and function, reference should be made to the flowing description:

As shown in FIG. 5, when the locking/unlocking apparatus for a drawer of the present invention is used to lock the drawer, the drive portion 51 of the drive element 50 disposed on the slidable slide rail 12 pushes against the first protrusion 31 of the slide block 30 to make the slide block 30 move in a direction opposite the second grove section 214, namely a direction toward the third groove section 215. At this moment, the first protruding cylinder 33 of the slide block 30 will be pulled by the spring 40 and finally engaged in the concave portion 233 (as shown in FIG. 7) under the guidance of the external annular surface 232 of the annular guide groove 23, the upper guide surface 231*a* of the internal annular surface 231, the upper surface 234*a* of the protruding portion 234, the first surface 231*b* and the external annular surface 232 of the annular guide groove 23 (as shown in FIG. 6). At this moment, the drive portion 51 of the drive element 50 will be stopped by the second protrusion 32 of the slide block 30 and cannot be pulled back when the slide rail 12 is pulled toward the second groove section 214 of the bar hole 212, thus finishing the locking operation (not shown).

As shown in FIG. 7, when the locking/unlocking apparatus for a drawer of the present invention is used to unlock the drawer, the drive portion 51 of the drive element 50 disposed on the slidable slide rail 12 pushes against the first protrusion 31 of the slide block 30 to make the slide block 30 move in a direction opposite the second groove section 214. At this moment, the first protruding cylinder 33 of the slide block 30 will be guided by the second surface 231*c* of the internal annular surface 231 of the annular guide groove 23 and then disengaged from the concave portion 233. After that, the first protruding cylinder 33 of the slide block 30 will be pulled by the spring 40 and finally return to its original position (as shown in FIG. 5) under the guidance of the lower surface 234*b* of the protruding portion 234, the external annular surface 232 of the annular guide groove 23, and the lower guide surface 231*d* of the internal annular surface 231, thus finishing the unlocking operation.

It is to be noted that, when the slide block 30 returns to its original position, the second protruding cylinder 32 of the slide block 30 is located at the second groove section 214 of the main body 20. Since the second groove section 214 is bent from the first groove section, the slide block 30 will swing by an angle around the first protruding cylinder 33 to make the second protruding cylinder 34 move upwards a distance, so that the second protruding cylinder 34 is not level with the drive portion 51 of the drive element 50. At this moment, the drive element 50 is fully disengaged from the slide block 30, so that the drawer body locked on the slidable slide rail 12 can be opened (not shown).

It is to be noted that, referring to FIG. 5 again, since the third groove section 215 of the annular guide groove 23 is bent in the upper-right direction from the first groove section 213, when the first protruding cylinder 31 of the slide block 30 slides along the rail groove 21, the first protruding cylinder will move along the annular guide groove 23 in the clockwise direction assuredly.

Figure 9:
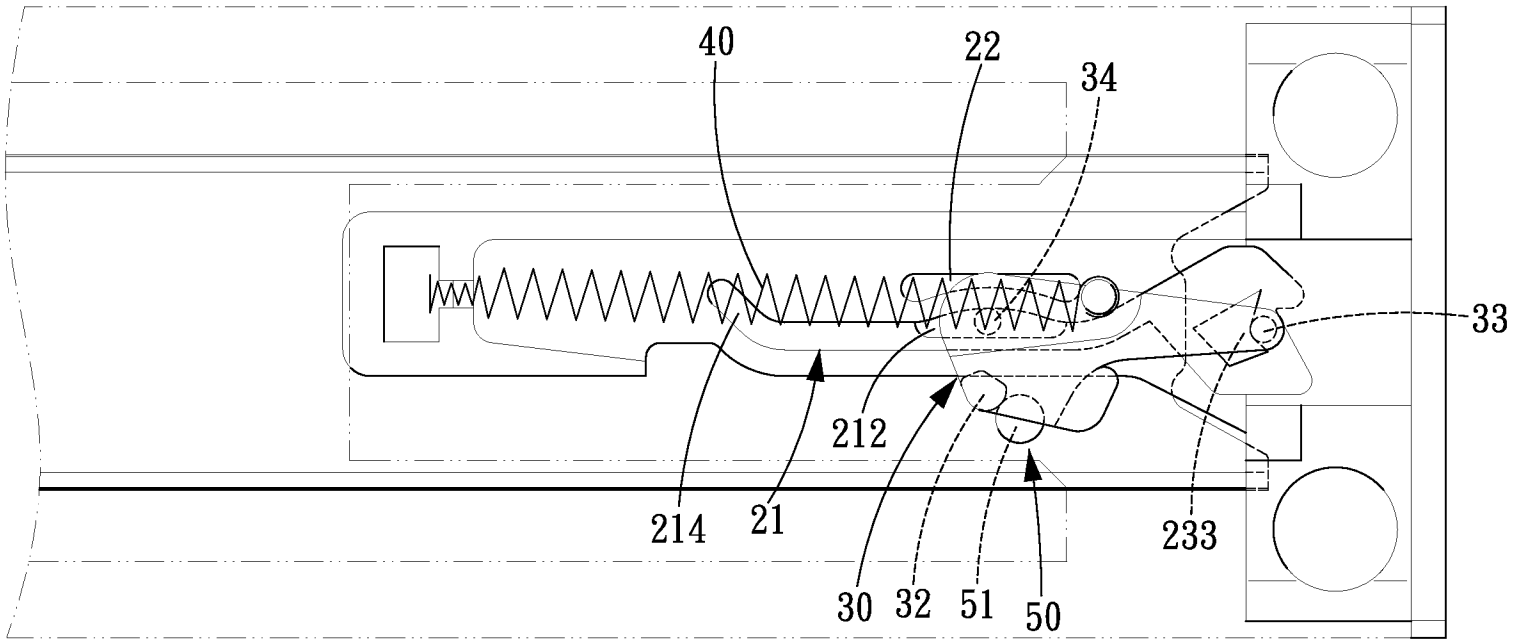
FIG. 9 is a fourth operational view, showing that the locking/unlocking apparatus for a drawer in accordance with the first embodiment of the present invention performs the unlocking operation.

Referring to FIGS. 7 and 9, when the locking/unlocking apparatus of the present invention is in the locking state, the first protruding cylinder 33 of the slide block 30 is engaged in the concave portion 233 of the main body 20, and the second protruding cylinder 34 is located in the bar hole 212 of the rail groove 21 and the slot 22. Under such a state, if the user pulls the drawer, the drive portion 51 of the drive element 50 disposed on the slidable slide rail 12 pushes against the second protrusion 32 of the slide block 30, since the first protruding cylinder 33 of the slide block 30 is engaged in the concave portion 233 of the main body 20, the drive element 50 cannot drive the slide block 30 to move toward the second groove section 214 of the rail groove 21 and will continuously apply a left pull force on the second protrusion 32 through the drive portion 51, synchronously making the second protruding cylinder 34 of the slide block 30 produce an upward push force.

Figure 10:
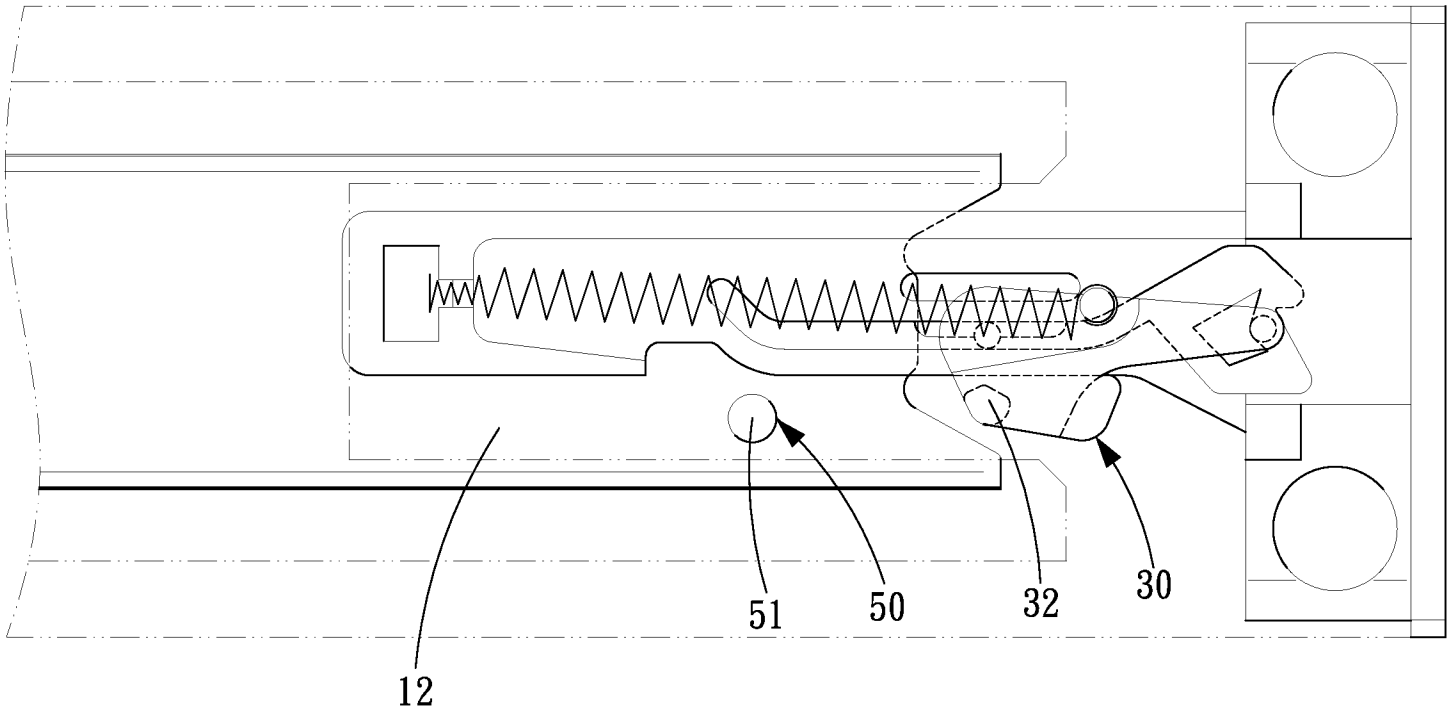
FIG. 10 is a fifth operational view, showing that the locking/unlocking apparatus for a drawer in accordance with the first embodiment of the present invention performs the unlocking operation.

When the second protruding cylinder 34 produces a push force bigger than the structural force of the structure between the rail groove 21 of the main body 20 and the slot 22, the slot 22 will be deformed by the pressing force from the second protruding cylinder 34 of the slide block 30. At this moment, the slide block 30 will swing by an angle around the first protruding cylinder 33 in the clockwise direction to make the second protrusion 32 move upwards a distance. When the second protrusion 32 is moved to a position which is not level with the drive portion 51 of the drive element 50, the slidable slide rail 12 can be smoothly disengaged from the slide block 30 (as shown in FIG. 10), so that the drawer body which is locked on the slidable slide rail 12 can be opened (not shown).

Hence, besides the locking/unlocking function, the locking/unlocking apparatus of the present invention can also avoid the damage to the slide rails or itself when the drawer is pulled by a large force.

Figure 11:
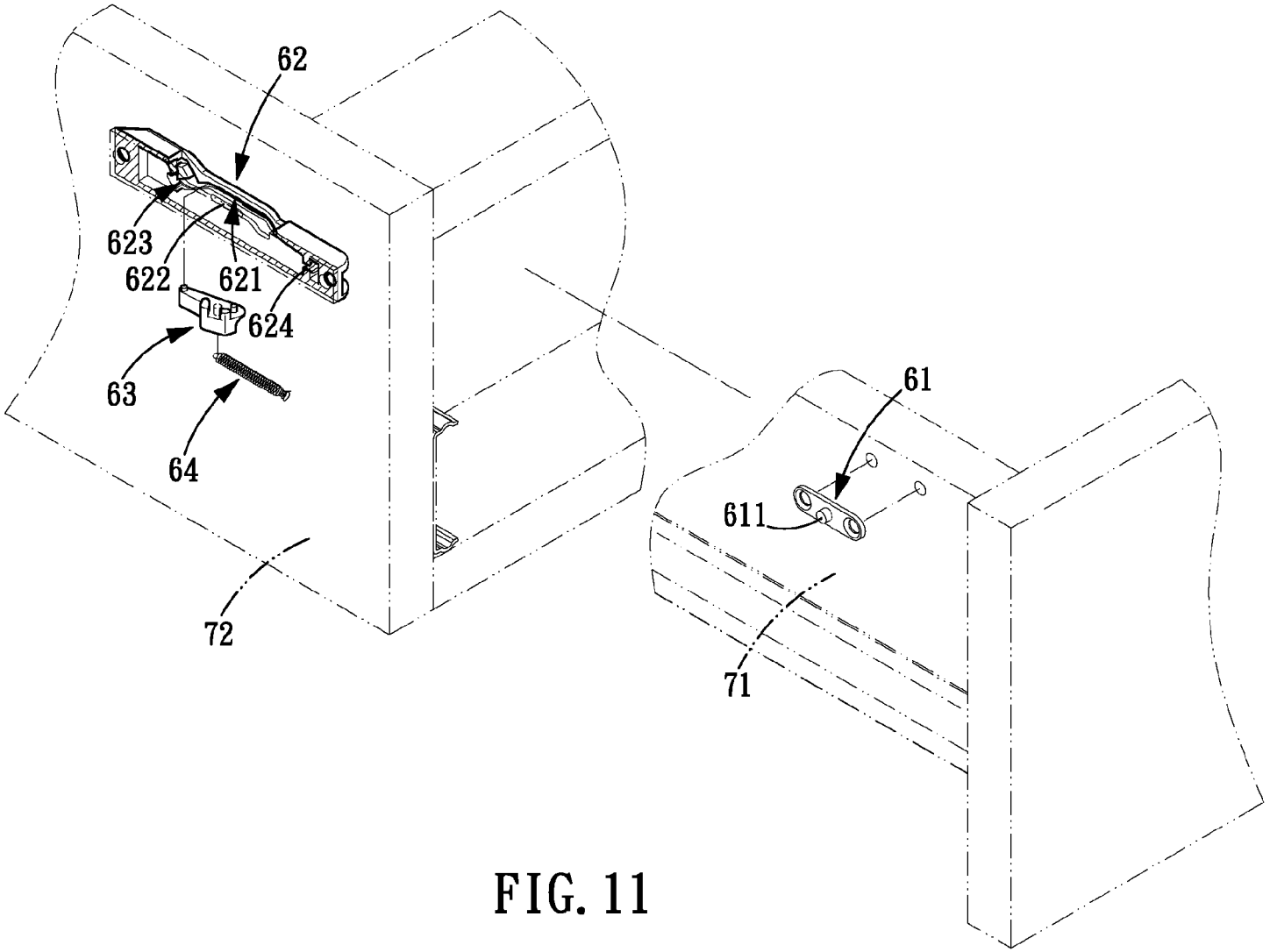
FIG. 11 is a perspective view of a locking/unlocking apparatus for a drawer in accordance with a second embodiment of the present invention.
Figure 12:
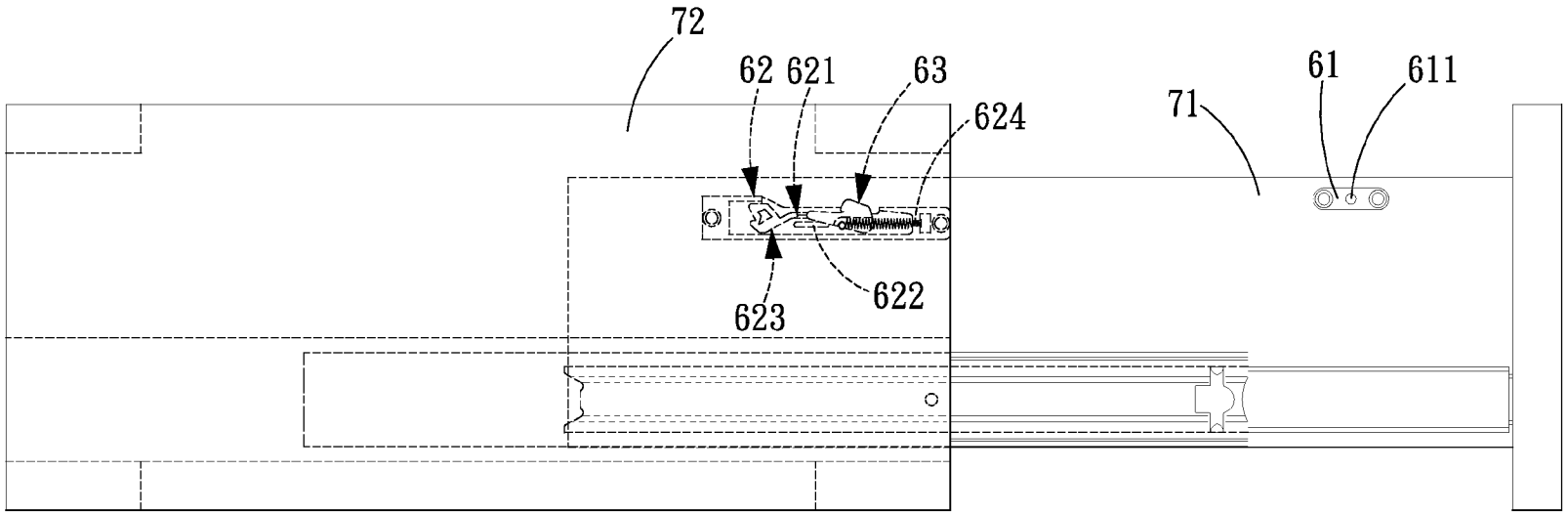
FIG. 12 is a side assembly view, showing the locking/unlocking apparatus for a drawer in accordance with the second embodiment of the present invention is disposed between the drawer cabinet and the drawer body.

Referring to FIGS. 11 and 12, a locking/unlocking apparatus for a drawer in accordance with a second embodiment of the present invention also comprises a drive element 61, a main body 62, a slide block 63 and a spring 64. Since its components, operation and function are the same as the first embodiment, further explanation is omitted herein. The second embodiment is different from the first embodiment in that:

The locking/unlocking apparatus in accordance with the second embodiment of the present invention is applicable to be assembled on the drawer body 71 and a drawer cabinet 72. The drive element 61 is disposed on an external surface of the drawer body 71 and also includes a drive portion 611. The main body 62 is fixed on an inner surface of the drawer cabinet 72 and also includes a rail groove 621, a slot 622 which is formed above the bar hole 212 and pressed to deform, an annular guide groove 623 in communication with the rail groove 621, and an engaging portion 624. Thereby, when the drawer is in the locking state, pulling the drawer body 71 with a large force cannot damage the drawer body 71 or the locking apparatus either.

While we have shown and described various embodiments in accordance with the present invention, it is clear to those skilled in the art that further embodiments may be made without departing from the scope of the present invention.

What is claimed is:

1. A locking/unlocking apparatus for a drawer being applicable to be assembled on a fixed slide rail and a slidable slide rail of a drawer, the automatic locking/unlocking apparatus comprising:

a drive element being formed on the slidable slide rail and including a drive portion;

a main body being fixed on the fixed slide rail and including a rail groove, a bar hole formed in a bottom surface of the rail groove, a slot which is formed above the bar hole and will deform when being pressed, and an annular guide groove in communication with the rail groove, the annular guide groove including an internal annular surface and an external annular surface connected to a groove surface of the rail groove, the internal annular surface including a concave portion, the external annular surface including a protruding portion in alignment with the concave portion;

a slide block including a first protrusion to be pushed by the drive portion of the drive element, a second protrusion to be pushed by the drive portion of the drive element, a first protruding cylinder which is slidably disposed in the rail groove and engaged in/disengaged from the concave portion of the annular guide groove, and a second protruding cylinder which is slidably disposed in the rail groove; and a spring including a first end connected to the main body, and a second end connected to the slide block.

2. The locking/unlocking apparatus for a drawer as claimed in claim 1, wherein the rail groove of the main body includes a first groove section, a second groove section bent from a first end of the first groove section, and a third groove section bent from a second end of the first groove section, the bar hole is formed in the first groove section.

3. The locking/unlocking apparatus for a drawer as claimed in claim 1, wherein the internal annular surface is formed by annularly connecting an upper guide surface, a first surface, a second surface, and a lower guide surface in order, the first surface and the second surface are connected and form a concave portion, the protruding portion of the annular guide groove is higher than the second surface but lower than the first surface.

4. The locking/unlocking apparatus for a drawer as claimed in claim 1, wherein the main body further includes an engaging portion connected to the first end of the spring, the slide block further includes a fastening portion connected to the second end of the spring.

5. The locking/unlocking apparatus for a drawer as claimed in claim 1, wherein when the first protruding cylinder of the slide block is engaged in the concave portion, the second protruding cylinder is located in the bar hole and the slot.

* * * * *